US005603598A

United States Patent [19]

Hasegawa et al.

[11] Patent Number: 5,603,598

[45] **Date of Patent: *Feb. 18, 1997**

[54] GUIDE CHUTE FOR CARGO CONTAINER HANDLING CRANES

[75] Inventors: Shuji Hasegawa; Masamitsu Enoki, both of San Mateo, Calif.

[73] Assignee: Paceco Corp., San Mateo, Calif.

[ * ] Notice: The term of this patent shall not extend beyond the expiration date of Pat. No. 5,570,986.

[21] Appl. No.: 225,543

[22] Filed: Apr. 11, 1994

[51] Int. Cl.[6] ..... B66C 5/02

[52] U.S. Cl. ..... 414/140.3; 212/272; 212/325

[58] Field of Search ..... 414/140.3, 140.4; 212/218, 219, 220, 147, 190, 191, 272, 324, 325, 326; 114/260

[56] References Cited

U.S. PATENT DOCUMENTS

| | | | |
|---|---|---|---|
| 3,375,938 | 4/1968 | Crittenden et al. . | |
| 3,515,086 | 6/1970 | Auzins et al. | 114/260 |
| 3,532,324 | 10/1970 | Crittenden . | |
| 3,739,922 | 6/1973 | Hasegawa et al. . | |
| 3,825,128 | 7/1974 | Cooper . | |
| 3,945,504 | 3/1976 | Wright . | |
| 4,049,139 | 9/1977 | Stromback | 212/218 |
| 4,106,639 | 8/1978 | Montgomery et al. | 212/219 |
| 4,172,685 | 10/1979 | Nabeshima et al. . | |
| 4,293,077 | 10/1981 | Makino | 212/219 |
| 5,186,342 | 2/1993 | Shimizu . | |

FOREIGN PATENT DOCUMENTS

| | | | |
|---|---|---|---|
| 294121 | 11/1989 | Japan | 414/140.3 |
| 313300 | 12/1989 | Japan | 212/326 |
| 789363 | 12/1980 | U.S.S.R. | 414/140.3 |

*Primary Examiner*—Thomas J. Brahan
*Attorney, Agent, or Firm*—Bruce & McCoy

[57] ABSTRACT

A method and apparatus for elimination of residual sway in a cargo container handling gantry crane for reducing container handling cycle times.

7 Claims, 6 Drawing Sheets

GUIDE CHUTE FOR CARGO CONTAINER HANDLING CRANES

CROSS-REFERENCE TO RELATED APPLICATION

The present invention is related to U.S. patent application Ser. No. 08/117,113 now abandoned, for Cargo Container Transfer Systems for Cranes filed Dec. 31, 1993, by Shuji Hasegawa and Masamitsu Enoki and assigned to Paceco Corp., which is incorporated herein by reference.

BACKGROUND OF THE INVENTION

1. Field of the Invention

The present invention relates to improved apparatus for the operation of cargo container handling cranes having a horizontal gantry supported at an elevated location above the cargo container pickup and deposition areas. More particularly, the present invention relates to the apparatus for reducing cargo container handling and transfer cycle times by employing positive residual sway arrest in a cargo container handling crane which transports containers horizontally along the gantry of the crane. Residual sway in the container pickup apparatus during lowering is arrested by passing it through a guide chute near the end of the lowering cycle.

2. Description of the Prior Art

The handling and protection of cargo or material during its transportation has been greatly facilitated by the advent of containerization many years ago. Rail mounted dockside gantry cranes having retractable booms have now been long accepted as the standard in the industry for loading and unloading containerized cargo and fungible bulk materials. The containers are moved by the cranes between waterborne vessels and dockside transportation equipment.

When a cargo container transport ship is berthed alongside a dock, a gantry crane is moved along the dock parallel to the ship to a position where a retractable boom can be extended across the beam of the ship above the ship's cells which are the cargo container carrying area. The retractable boom in its operating position extends horizontally outboard from the crane's superstructure and, in its retracted position, clears the superstructure of any ship berthed alongside the dock adjacent to the crane. Containers can be transported along the gantry of the crane between the dockside pickup and deposition area and any storage position located within the beam of a berthed ship in its holds or on its deck.

The gantry portion of the cargo container handling crane includes the retractable boom and a dockside portion and a rear extension of said boom supported by the crane superstructure. Trolleys run along the gantry and suspend cargo container lifting spreaders from fleet-through wire rope reeving for attaching to and picking up cargo containers. The purpose of a gantry crane is to move cargo containers a specific horizontal distance from a pickup area to a deposition area. In each operation, in the most usual situation, the pickup area is either a dockside location where a container is picked off of a flatbed trailer or transport truck or railroad car, and moved outboard by the crane and lowered into a shipboard cargo container cell, or the reverse, wherein a container is lifted from a cell onboard ship and moved to a dockside storage area or a truck, trailer or railroad car.

In a transfer cycle by a crane, the container must first be picked up, then lifted vertically, moved horizontally, and then lowered to its deposition area. During a portion of the move, vertical and horizontal movement of the container can occur simultaneously. For each transfer cycle, the crane must raise or lower a container a specific distance to clear the side of a ship, and a round trip transfer cycle takes a substantial period of time to handle one container. The container handling capacity of a crane is determined and limited by the transfer cycle time. It is an important consideration in the design of a crane to lower cycle times by any small improvement possible.

In addition to the portion of the transfer cycle time required to pickup, lift, move, lower, and deposit the container, there is also a delay at each end of the cycle because of sway or pendulum movement which is induced into the load by virtue of the starting and stopping of the horizontal movement of the container lifting apparatus along the gantry. It takes additional time to abate the sway and to position the container by selectively controlling the forward and reverse movement of the trolley.

Numerous methods and apparatus have been developed for arresting sway in containers and lifting spreaders suspended by wire rope reeving. The problem is most acute at the shoreside container pickup and deposition areas where the containers are picked up or deposited close to ground level from or onto truck or trailer beds, railroad cars, or stacks of containers, and where the lifting spreader is suspended at its longest pendulum length for this purpose.

Some of the methods and apparatus for arresting sway in suspended cargo containers are disclosed in the following patents: U.S. Pat. No. 3,375,938 for Anti-Sway Device; U.S. Pat. No. 3,532,324 for Antisway Mechanism; U.S. Pat. No. 3,739,922 for Sway-Arrest System Improvement; U.S. Pat. No. 3,825,128 for Sway-Arrest System; U.S. Pat. No. 3,945,504 for Anti-Sway System for a Spreader Suspended from a Crane; and U.S. Pat. No. 5,186,342 for Integrated Passive Sway Arrest System for Cargo Container Handling Cranes; all of which are assigned to the assignee of the present invention.

The problem of arresting sway in the cargo container lifting apparatus at the shipside end of the transfer cycle is abated somewhat due to the height of the ship's deck which shortens the length of the suspension ropes, reduces the effect of the pendulum motion, and allows the sway arresting apparatus to be more effective. The containers are lowered into cells in the holds of a ship and all of the cell guides extend upward to the ship's deck from within the holds of the ship. When the ship's cells are full and the containers are stacked and lashed on top of a ship's deck, the suspension ropes are shortened even further, reducing even more the effect of the pendulum motion and enhancing the effect of any sway arresting apparatus.

A more recent development in the field of cargo container handling which reduces even further the length of the suspension ropes at the shipside end of the transfer cycle is the development of the hatch coverless container ships but which unfortunately has increased the container transfer cycle time in the prior art gantry cranes. These ships were developed to reduce lashing work or container tie down time for containers stacked on the open deck of the ship. This development provides cell guides which project upwards from the deck of the ship and which therefore require every vertical movement of a container to clear not only the side of the ship but the tops of all the upward projecting cell guides as well which previously did not extend above the ship's deck. In every cycle, however, the shipside end of the transfer cycle deposits a container into the top of the decktop cell guides when the container suspension ropes are shortest and the effect of the pendulum motion is the least and the sway arresting apparatus of the prior art is most effective.

Despite the shipside cargo container sway arrest advantages, the container handling productivity for hatch coverless ships is considerably lower in comparison with conventional container ships. That is because the handling pass or transfer cycle is substantially longer due to the height every container must be lifted to clear the tops of the on-deck cell guides until stacked containers on a conventional ship's deck gradually increase the time of the handling pass or transfer cycle. In both conventional and hatch coverless ships, the most acute sway arrest problem occurs at the shoreside end of the transfer cycle, and there is no known prior art which deals with this problem apart from the methods and apparatus that are utilized to arrest sway in the same manner at either end of the transfer cycle.

A further improvement in the art of sway arrest at the shoreside end of a container transfer cycle is disclosed in the related invention for a Cargo Container Transfer System for Cranes wherein the lifting spreader is dropped through a guide chute at the shoreside end of the cycle before picking up or depositing a cargo container. The present invention is an improvement on the guide chute disclosed therein.

The improved guide chute of the present invention overcomes the limitations of the prior art sway arrest devices by providing more efficient double function apparatus and method of operation for sway arrest apparatus which lower the cycle transfer time by effectively arresting residual sway of cargo container lifting apparatus at the shoreside end of the transfer cycle.

SUMMARY OF THE INVENTION

The present invention is an improved lifting spreader guide chute mounted on a cargo container handling crane. The guide chute has a framework forming a pass-through opening for the chute suspended from the supporting structure of the crane and formed for arresting the sway of lifting spreaders being lowered therethrough. The spreader guides are formed to guide the retraction of lifting spreaders being lifted and retracted therethrough. The guides are comprised of a multiplicity of depending arms secured to the framework at their upper ends by pivot connections. The arms are disposed on opposite sides of the pass-through opening of the chute along the length thereof in opposed relation. A means is provided for moving the lower ends of the arms outward and away from the vertical planes forming the pass-through opening a uniform distance substantially simultaneously and to return them to a vertical orientation adjacent the outside of the planes of the opening likewise substantially simultaneously. A means is provided for supporting cargo containers by said guide chute framework and effectively blocking the pass-through passage to the passage of cargo containers therethrough.

OBJECTS OF THE INVENTION

It is therefore an important object of the present invention to provide a improved guide chute apparatus for reducing the cycle time of the operation of a cargo container handling crane.

It is another object of the present invention to provide apparatus for arresting residual sway in the container lifting apparatus at the shoreside end of a cargo container handling dockside crane.

It is a further object of the present invention to provide apparatus for passing a cargo container lifting spreader through a guide chute at the shoreside end of a cargo container handling operation.

It is still another object of the present invention to provide a cargo container handling gantry crane with a stopper which supports a loaded cargo container lifting spreader above a shoreside container deposition area while an operator positions a transport vehicle under the lifting spreader.

And it is yet a further object of the present invention to provide guided passage of a rising lifting spreader through a movable guide chute and permitting free passage therethrough during the lifting of said spreader from below and through said chute.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention and the prior art wherein like reference numbers represent like elements on corresponding views.

Figure 1:
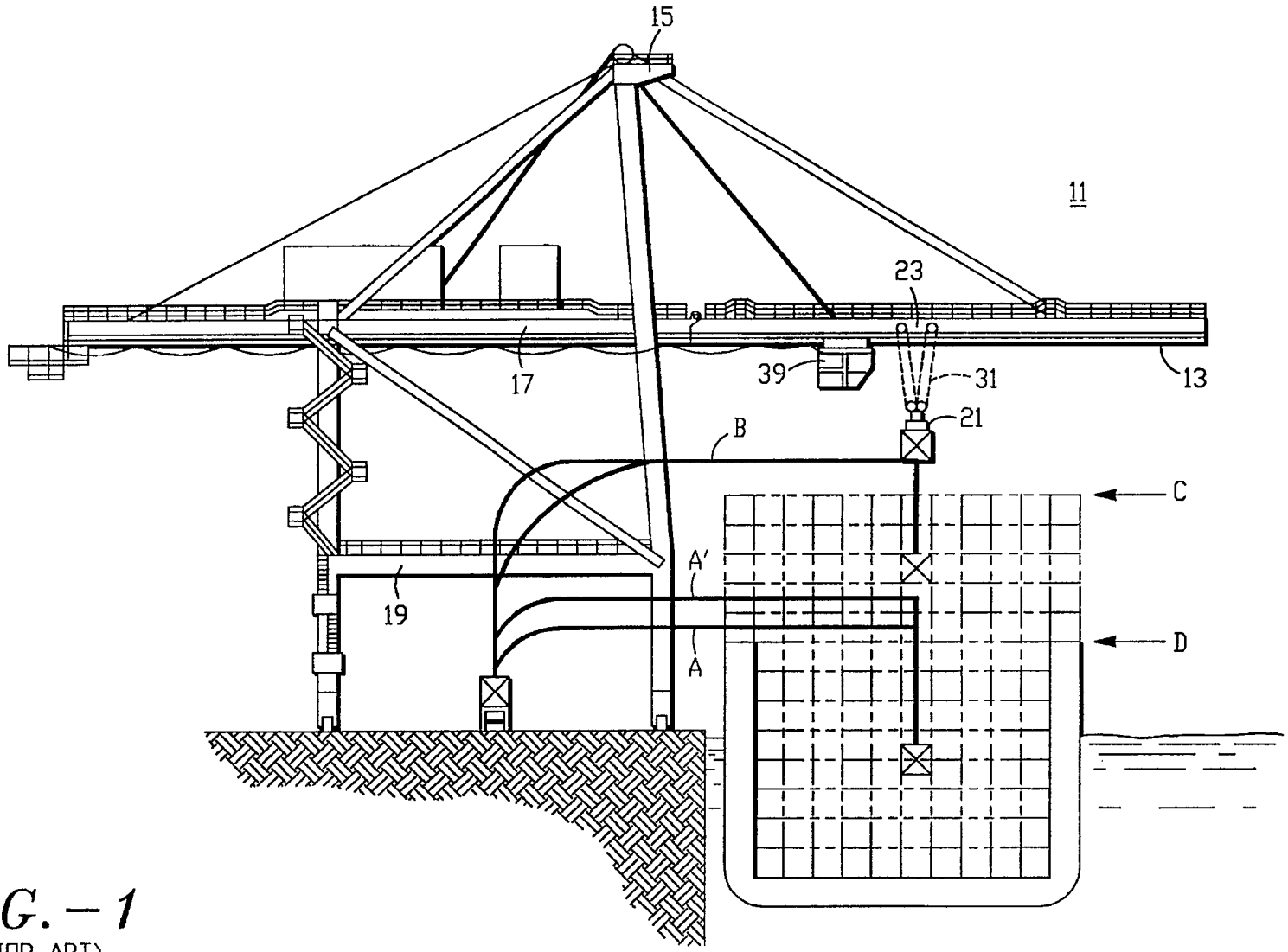
FIG. – 1 (PRIOR ART)
FIG. 1 is a side elevation of a typical cargo container handling gantry crane illustrating the loading of both standard and hatch coverless container ships shown in partial cross-section.

Reference is made to FIG. 1 of the drawings for an illustration of a cargo container handling gantry crane 11 with a retractable boom 13 which projects outboard from the superstructure 15 of the crane over the beam of a ship berthed alongside the dock. The boom in the illustrated embodiment folds upward to project just short of vertically whereby the superstructure of a ship can pass alongside the dock and not interfere with the boom when it is raised. In other types of gantry cranes, where height restrictions limit raising the boom, typically in ports located near airports, the gantry can slide horizontally outboard over a ship or partially fold when it is raised.

The horizontal gantry 17 of the crane extends rearward of the retractable boom in a portion which resides within the superstructure 15 of the crane, and projects further rearward out over a storage area on the landside end of the crane. It is supported at an elevation above container pickup and deposition areas. The gantry is designed to project outboard over a ship moored alongside a dock and the crane superstructure is designed to straddle the dockside cargo container pickup and deposition areas to move containers from and to shoreside transportation. Railroad tracks and roadways pass underneath the superstructure and rear projection of the crane for the delivery and removal of cargo containers thereunder by transportation equipment. The crane superstructure also includes horizontal crossbracing 19 disposed below the gantry.

When loading a standard container ship, the containers need be lifted only high enough to clear the side of the ship, and the raise and lowering cycles are greatly reduced as are illustrated by container transfer paths A and A'. This occurs because the container cells are all disposed within the hold of a ship illustrated by the dashed lines. Container path A represents movement of containers into the ship holds. Once the ship has been filled, then containers are stacked on top of the deck of the ship and lashed thereto. The deck level of the ship is designated by D. During this portion of the loading sequence, the containers must be lifted only high enough to clear any on-deck containers represented by container path A' where one level of containers are lashed on deck.

The hatch coverless type of ship is also illustrated by this same illustration by showing the dashed lines of the cells extending to C above the ship's deck. Thus, for the deposition of each container on a hatch coverless ship, it must be raised to clear all of the cell structure above the deck of the ship for each container transfer cycle. While the time needed to lash the containers to the deck is greatly reduced by the hatch coverless ship, the cycle time for container transfer is increased for each container because of the additional specific lifting and lowering distance which must be covered during each cycle to clear the cell structures on top of the deck of the ship.

Figure 2:
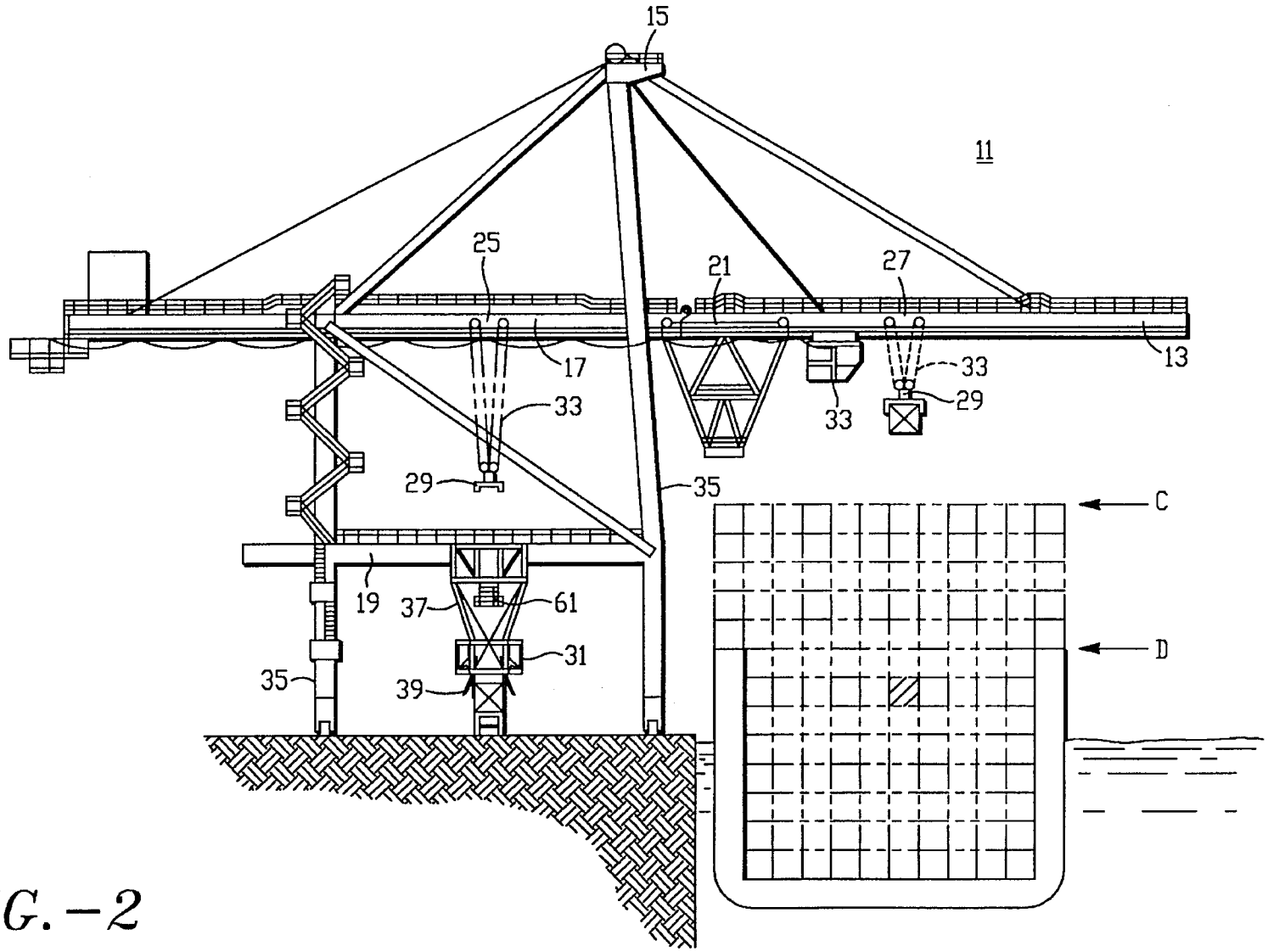
FIG. 2 is a side elevation of a cargo container handling gantry crane with a guide chute suspended from the cross-bracing on a pair of girders.

Reference is made to FIG. 2 of the drawings which shows the related invention which discloses an improved version of a cargo container handling gantry crane 11 which employs an automatic shuttle 21 to transport containers along the horizontal gantry 17 between trolleys 25, 27 that suspend cargo container lifting spreaders 29. A guide chute 31 is provided for arresting sway of the lifting spreaders at the shoreside end of the gantry. The present invention is an improvement on the guide chute disclosed therein.

The configuration of the preferred embodiment of the improved guide chute 31 of the present invention which is designed to be employed in the related invention to further reduce cargo container transfer cycle time. The pair of trolleys 25, 27 are disposed at opposite ends of the gantry 17 and can be located at variable locations on the gantry to lift and lower cargo containers from and to pickup and deposition areas located below the gantry. The trolleys are supported on rails that are secured to the gantry. Two pairs of collinear different gauge tracks are mounted on the gantry of the crane, and in the preferred embodiment, the trolleys are mounted on the narrower pair and the shuttle 21 is mounted on the wider pair.

Standard computer control of the trolleys 25, 27 utilizes an encoder which counts revolutions of the drive motors or wire rope drums which operate the drive machinery and spreader suspension ropes 33. An optical pulse generator is created by passing an optical beam through a perforated disk which is secured to the drive motors or wire rope drums. An optical detector senses the breaks in the optical beam caused by the disk, and they are counted by the computer whereby the exact position of a cargo container, both vertically and horizontally, with respect to the gantry, and the relative movement with respect thereto, can be accurately determined, whereby the transfer of the containers is accurately controlled. This is fundamental technology in cargo container handling by a crane, and once a spreader has been attached to a container or released, movement of the trolleys, the spreaders 29 and the shuttle 21 are computer control led.

However, operator control is required at each end of the cycle for two purposes: attachment of a lifting spreader 29 to a container, or positioning of a container for deposition. At the landside end of the crane, the operator must accurately locate the spreader above a container for pickup or deposition from or to a trailer, truck, railroad car, or a stack of containers in a storage area. The operator at the shipside end of the crane must also accurately locate a spreader either unloaded or carrying a container for lowering into a ship's cell or onto a stack of containers freestanding on the deck of a ship.

To assist in locating a lifting spreader 29, either unloaded or carrying a container, the related invention contemplates providing apparatus for arresting residual sway in the spreader of at the shoreside end of the crane by providing an improved movable lifting spreader guide chute 31 disposed below the gantry 17. The chute can be accurately located above the container pickup and deposition areas located under the crane's superstructure and is formed for preventing lateral movement of lifting spreaders 29 being lowered or raised therethrough. The container guide chute is formed to permit the guided but relatively free passage of lifting spreaders that are raised therethrough. The lifting spreader guide chute is provided at one end of the gantry proximate the shoreside pickup and deposition areas.

The guide chute 31 is suspended from the crossbracing girders 19 extending between the legs 35 of the gantry crane. The crossbracing girders extend rearward under the cantilevered rear projection of the crane gantry 17 over the landside container deposition and pickup areas. The guide chute is mounted on rails which are secured to the crossbracing so that it can be moved longitudinally along the girders whereby it can be disposed over almost any of the area underneath the crane where containers can be stored on landside storage areas or located in landside transportation pickup and deposition areas.

In a typical embodiment of the guide chute apparatus 31, wheels secured to the framework of the chute are disposed above and below the girder due to the low center of gravity of the mass of the guide chute to prevent it from disengaging from the rails mounted on the girder. A rack and pinion drive motor secured to the trolley framework of the guide chute can be utilized to move it along the crossbracing under computer control.

The guide chute 31 has an open framework 37 essentially made of tubes to keep it lightweight and provide a rectangular opening disposed at the lower end of the framework forming the pass-through feature thereof. The container guide chute has openable and closable guides for alternately enlarging and constricting the pass-through opening of the chute. This controllable feature, in turn, allows either relatively unimpeded pass-through or control of the lateral movement of a lifting spreader passing therethrough. The openable and closable guides are disposed at the lower end of the guide chute for effecting the relatively free passage of a lifting spreader through the chute when they are in the open condition and a lifting spreader is rising through the chute. In their simplest form, they are simply panels pivoted at their upper ends in the guide chute which open and close to enlarge or restrict the pass-through opening.

In the preferred embodiment of the present invention, the guides are a multiplicity of depending guide bars or arms 39 which are pivoted at their upper ends to the rectangular framework 37. The arms are disposed on opposite sides of the rectangular pass-through opening 41 along the length thereof in opposed relation. Means are provided for moving the lower ends of the arms outward and away from the vertical planes forming the pass-through opening, a uniform distance simultaneously, and to return them to a vertical orientation adjacent to the outside of the planes of said opening, likewise substantially simultaneously. The arms can be actuated by hydraulic cylinders 43 or other motivating means such as electric motors, solenoids, or air cylinders.

The guide bars 39 are provided with extension wings 45 which project at an angle outward from the vertical planes of the pass-through opening 41 and above the pivot connection 47 of the arms to the framework 37. The hydraulic cylinders 43 are secured between the framework of the guide chute and the ends of the extension wings to actuate the arms. The guides can be closed for arresting the residual sway of a descending lifting spreader by restricting the lateral movement of the spreader in the pass-through opening of the chute. This arrangement arrests residual sway in a suspended container after horizontal transit and during lowering to assist the accurate placement of the load on the deposition target.

The guide chute of the present invention can be utilized as a sway arrest mechanism for any type of crane which moves cargo horizontally wherein the cargo has a known external configuration whereby the size of the interior cavity opening of the guide chute can be predetermined whereby all cargo suspended by the lifting apparatus can be passed through it with close tolerances.

Figure 3:
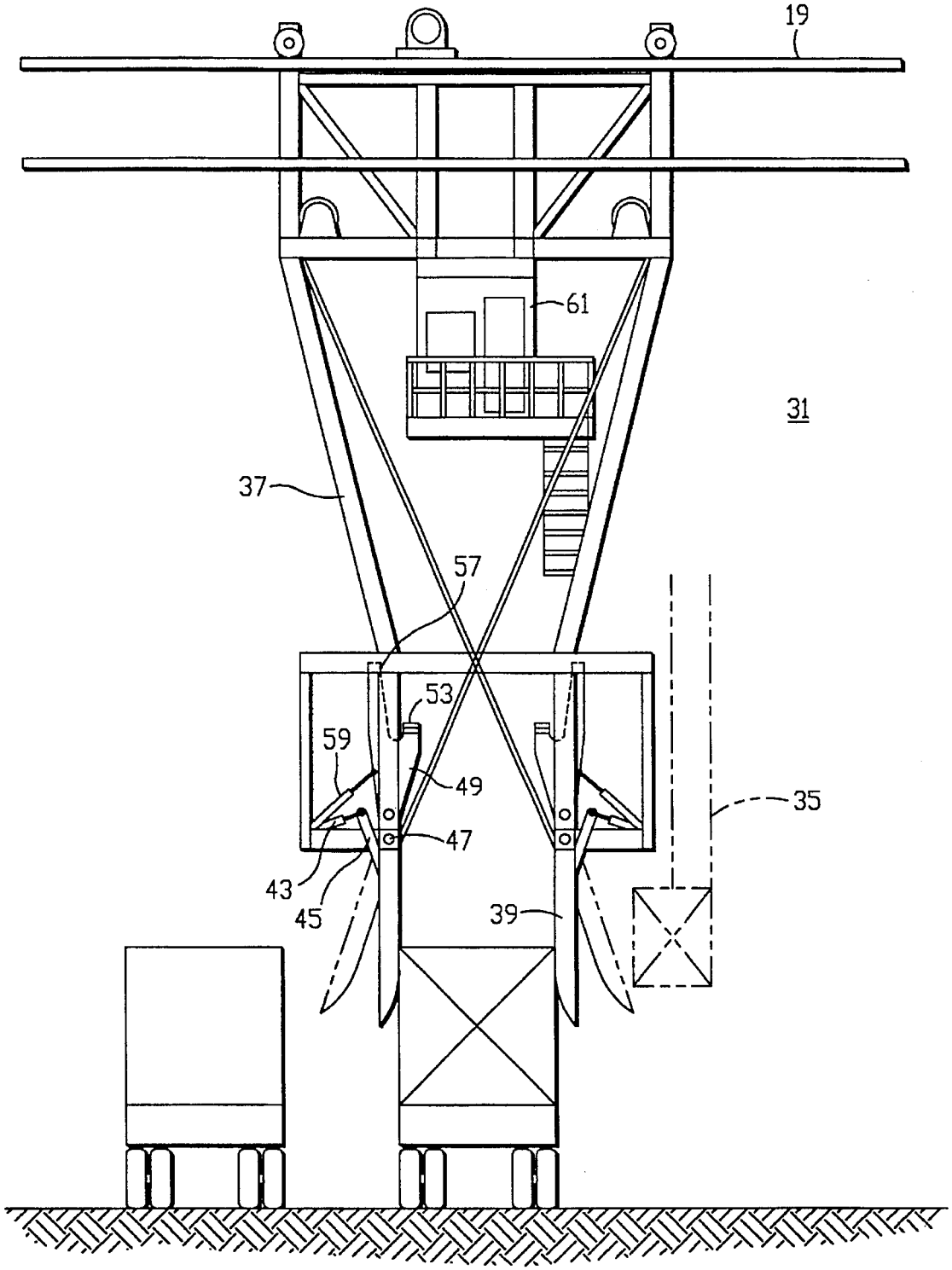
FIG. 3 is a broken out end elevation of the guide chute of FIG. 2.
Figure 6:
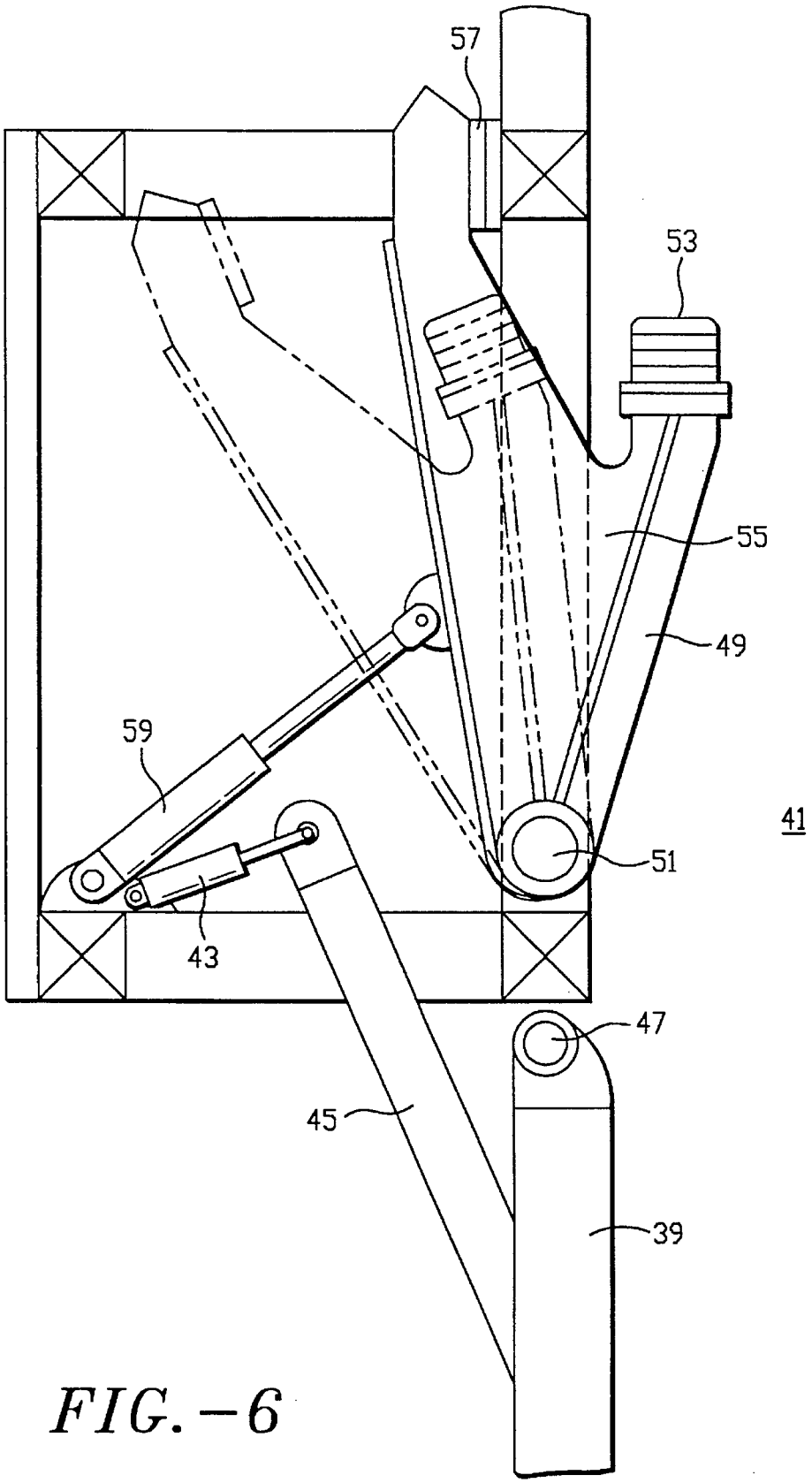
FIG. 6 is a broken out side elevation of the stopper mechanism of the guide chute of FIG. 3.

Reference is made to FIGS. 3 and 6. Cargo container support means are utilized in the present invention for a lifting spreader guide chute 31 mounted on a cargo container handling crane 11. The support means is comprised of a multiplicity of pairs of rocker arms 49 secured to the framework 37 on opposite sides of the pass-through opening 41 with pivot connections 51. The rocker arms are formed to project into the pass-through opening of the guide chute when they are rotated inward about their pivot connections and to retract clear of the opening when they are rotated outward about the pivot connections.

Cargo container bumper topped support surfaces 53 are formed on the rocker arms 49 to engage the underside of an edge of a cargo container when the rocker arms are rotated inward about their pivot connections 51. The rocker arms include a rib member extending from the pivot connection to the support surface. Stop blocks 57 are also formed on the rocker arms to engage the framework 37 of the chute 31 when the rocker arms are rotated inward to limit the projection of the support surfaces into the pass-through opening 41 and to carry a portion of the load imposed on the rocker arms when the support surfaces are carrying a cargo container. The stop blocks are formed to engage a portion of the framework at a position above the support surface track of rotation about the pivot connection of the arms. Hydraulic cylinders 59 are provided for reciprocating the rocker arms inward and outward.

Figure 4:
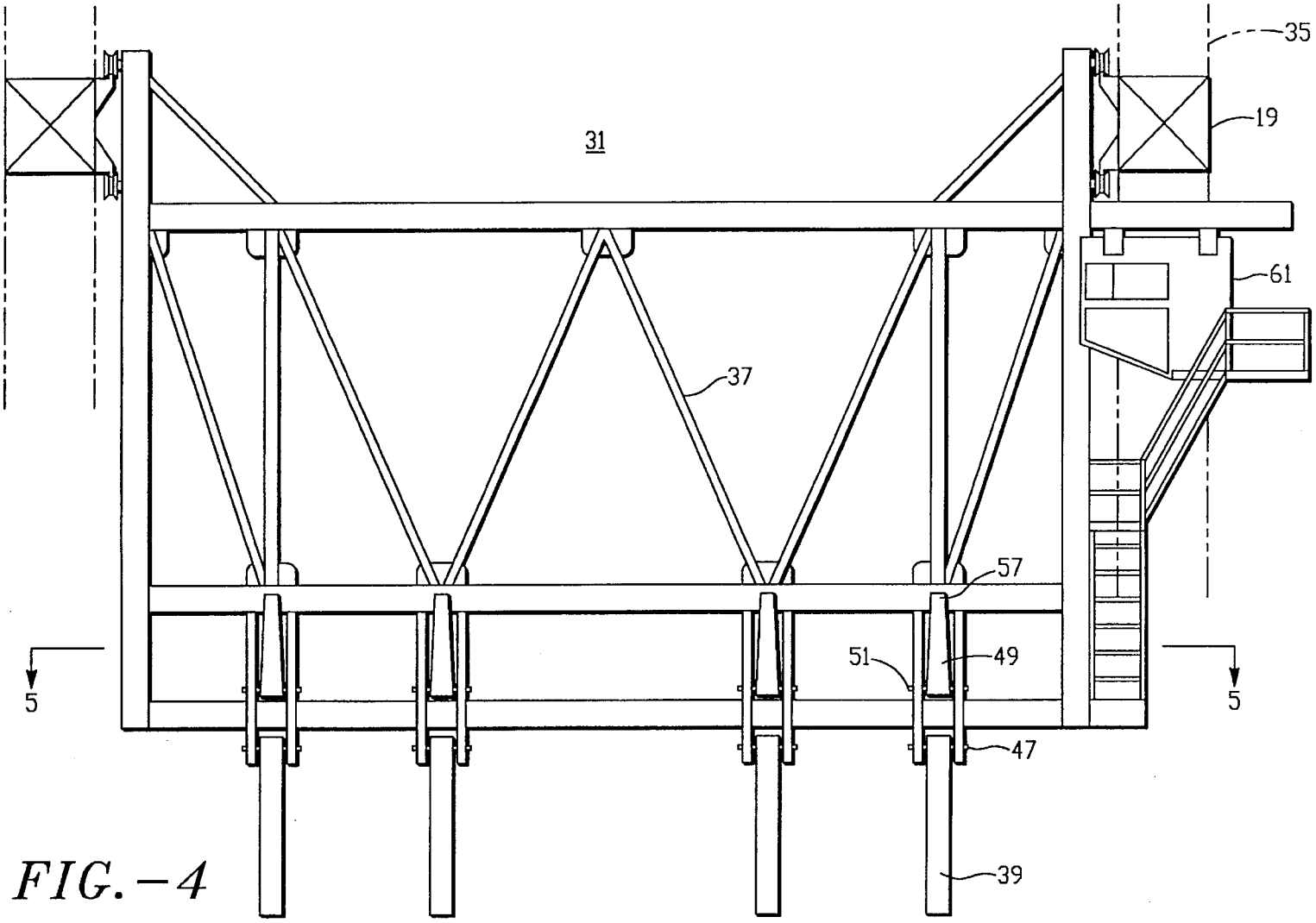
FIG. 4 is a broken out side elevation of the guide chute of the present invention.
Figure 5:
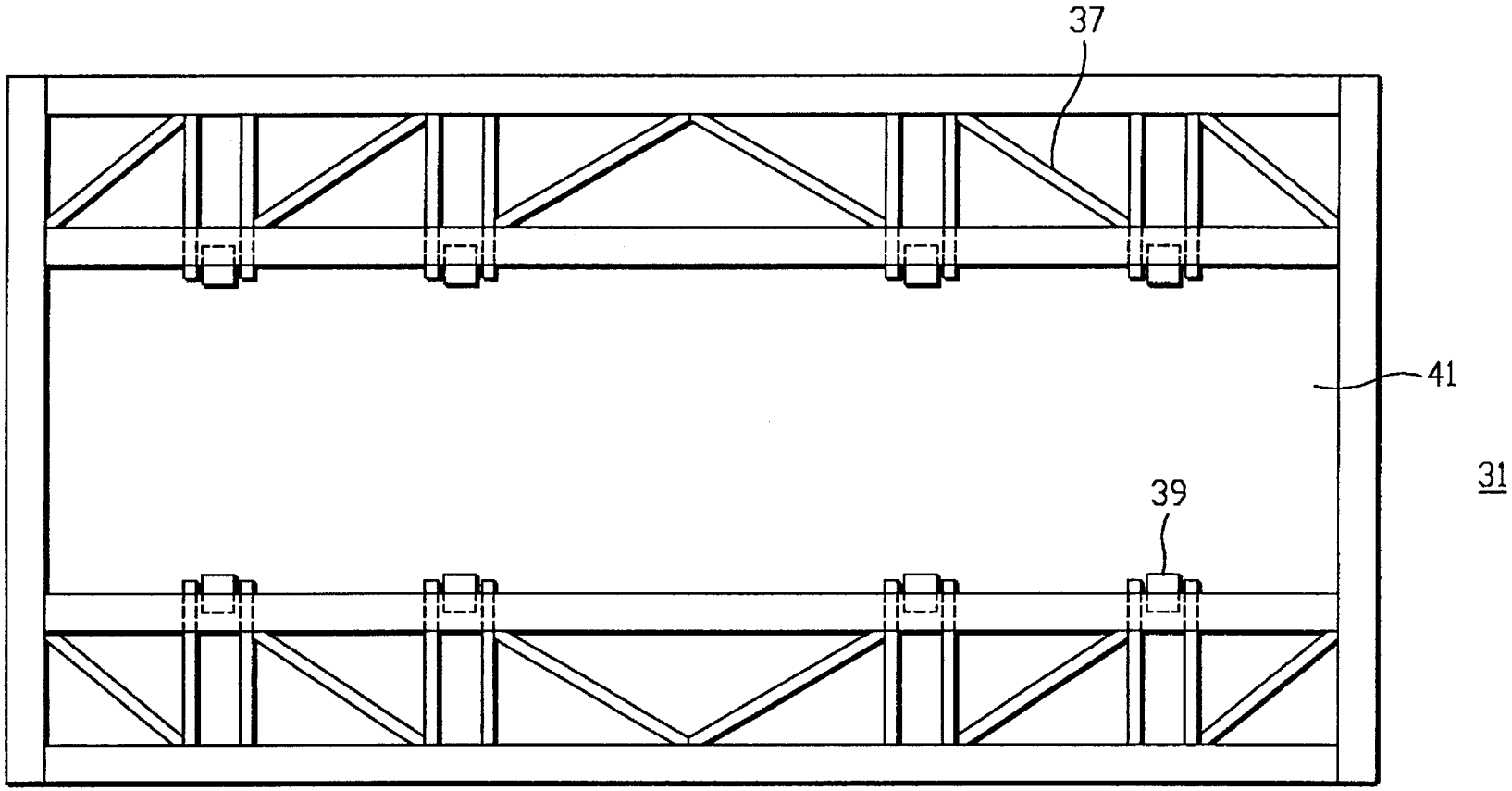
FIG. 5 is a broken out top plan view of the guide chute of FIG. 3.

Reference is made to FIG. 4. The guide chute 31 is comprised of the rectangular framework 37 which forms a pass-through opening in the top plan view for arresting the sway of lifting spreaders which are lowered therethrough by being restrained against lateral movement of the sides of the opening until the sway stops. The framework from which the rectangular framework depends is formed of angled guide bars which act as the sides of the chute.

The spreader stoppers, the stop blocks on the rocker arms, are a safety feature. Under current cargo handling safety regulations, a chassis operator, such as a truck driver, cannot move a truck or container chassis under a free-hanging lifting spreader suspended by wire rope. With the guide chute of the present invention, stopper means are provided in the guide chute to block a container and spreader combination from passing downward through the guide chute and support its weight. The guides can be closed upon command to stop and support a container for this purpose. In this manner, a chassis operator may drive or move the chassis into receiving position under the supported load. Then, the load can be released and placed on the chassis saving time and eliminating unnecessary chassis operator evacuation procedures during loading.

Reference is made to FIG. 2. An operator's cab 61 is disposed proximate the lifting spreader guide chute 31 and is secured thereto whereby it is formed to move therewith as the chute is moved to different locations along the cross-bracing 19. This permits the operator to be continually located close to the container pickup area where the lifting spreader 29 must be attached to a cargo container located on shoreside transportation or in a storage area.

Thus, it will be apparent from the foregoing description of the invention in its preferred form that it will fulfill all the objects and advantages attributable thereto. While the apparatus and method of the present invention have been illustrated and described in considerable detail, the invention is not to be limited to such details as have been set forth except as may be necessitated by the appended claims.

We claim:

1. A lifting spreader guide chute for a cargo container handling crane having an elevated gantry mounted near the top of a supporting structure of said crane and a trolley mounted on said gantry for suspending cargo container lifting spreaders therebelow, said guide chute comprising support rails mounted on said supporting structure below said gantry and parallel thereto, said rails extending over cargo pickup and deposition areas at one end of said crane, a framework suspended from said support rails and formed for movement therealong, said cargo container lifting spreaders being formed for lowering cargo containers through said framework when depositioning said containers, said framework including sloped side walls terminating proximate their lower ends in a restricted clearance pass-through opening for said chute for arresting the sway of lifting spreaders being lowered therethrough by restricting the pendulum sway of a lifting spreader between the converging sloped side guide walls until the sway of the descending spreader is restricted within said pass-through opening.

2. The lifting spreader guide chute of claim 1 including spreader guides suspended from said framework and formed to guide the upward movement of lifting spreaders being lifted therethrough, said guides being secured to said framework by pivot connections and disposed on opposite sides of said pass-through opening of said chute along the length thereof in opposed relation, and means for moving the lower ends of said guides outward and away from the vertical planes forming said pass-through opening a uniform distance substantially simultaneously, forming inverted sloped sided walls below said pass-through opening, and to return them to a vertical orientation adjacent the outside of the planes of said opening likewise substantially simultaneously.

3. The lifting spreader guide chute of claim 2 wherein said guides are comprised of a multiplicity of depending arms secured to said framework at their upper ends, and means are provided for supporting cargo containers by said guide chute framework for effectively blocking said pass-through opening to the passage of cargo containers therethrough.

4. The lifting spreader guide chute of claim 3 wherein said arms of said spreader guides are provided with extension wings which project at an angle outward from the vertical planes of said pass-through opening and above the pivot connection of said arms to said framework, and said means for moving said arms includes hydraulic cylinders secured between said framework and said extension wings.

5. The lifting spreader guide chute of claim 3 wherein said means for supporting cargo containers comprises supports mounted on said guide chute framework which forms a pass-through opening for said chute, said supports include a multiplicity of pairs of rocker arms secured to said framework on opposite sides of said pass-through opening with pivot connections, said rocker arms being formed to project into said pass-through opening of said guide chute when rotated inward about said pivot connections and to retract clear of said opening when rotated outward about said pivot connections, cargo container support surfaces formed on said rocker arms to engage the underside of an edge of a cargo container when said rocker arms are rotated inward, stop blocks formed on said rocker arms to engage said framework of said chute when said rocker arms are rotated inward to limit the projection of said support surfaces into said opening and to carry a portion of the load imposed on said rocker arms when said support surfaces are carrying a cargo container, and means for reciprocating said rocker arms inward and outward.

6. A lifting spreader guide chute mounted on a supporting structure of a cargo container handling crane, said guide chute comprising a framework forming a pass-through opening for said chute suspended from the supporting structure of said crane and formed for arresting the sway of lifting spreaders being lowered therethrough, spreader guides suspended from said framework and formed to guide, the upward movement of lifting spreaders being lifted and retracted therethrough, said guides including a multiplicity of depending arms secured to said framework at their upper ends by pivot connections, said arms being disposed on opposite sides of the pass-through opening of said chute along the length thereof in opposed relation, said arms being provided with extension wings which project at an angle outward from the vertical planes of said pass-through opening and above the pivot connection of said arms to said framework, hydraulic cylinders secured between said framework and said extension wings for moving the lower ends of said arms outward and away from the vertical planes forming said pass-through opening a uniform distance substantially simultaneously and to return them to a vertical orientation adjacent the outside of the planes of said opening likewise substantially simultaneously, means for supporting cargo containers by said guide chute framework and effectively blocking said pass-through opening to the passage of cargo containers therethrough, a multiplicity of pairs of rocker arms secured to said framework on opposite sides of said pass-through opening with pivot connections, said rocker arms being formed to project into said pass-through opening of said guide chute when rotated inward about said pivot connections and to retract clear of said opening when rotated outward about said pivot connections, said rocker arms being pivoted about their lower ends in their pin connections to said framework and include a rib member extending from said pivot connection to said support surface, cargo container support surfaces formed on said rocker arms to engage the underside of an edge of a cargo container when said rocker arms are rotated inward, stop blocks formed on said rocker arms to engage said framework of said chute when said rocker arms are rotated inward to limit the projection of said support surfaces into said opening and to carry a portion of the load imposed on said rocker arms when said support surfaces are carrying a cargo container, said stop blocks being formed to engage a portion of said framework at a position above said support surface track of rotation about said pivot connection, and means for reciprocating said rocker arms inward and outward.

7. The cargo container supports of claim 6 wherein said rocker arms are pivoted about their lower ends in their pin connections to said framework and said rocker arms include a rib member extending from said pivot connection to said support surface and said stop blocks are formed to engage a portion of framework at a position above said support surface track of rotation about said pivot connection.

* * * * *